US005522631A

United States Patent [19]

Halonen

[11] Patent Number: 5,522,631

[45] Date of Patent: Jun. 4, 1996

[54] MEANS FOR, AND A METHOD OF, HANDLING A SUBMERSIBLE EQUIPMENT WHICH HAS A LIFTING BAIL

[75] Inventor: Kauko Halonen, Sunbyberg, Sweden

[73] Assignee: ITT Flygt AB, Solna, Sweden

[21] Appl. No.: 349,339

[22] Filed: Dec. 5, 1994

[30] Foreign Application Priority Data

Jan. 4, 1994 [SE] Sweden ..... 9400015

[51] Int. Cl.[6] ..... B66C 1/26

[52] U.S. Cl. ..... 294/66.1; 294/82.31

[58] Field of Search ..... 294/66.1, 66.2, 294/82.1, 82.11, 82.31, 68.1, 68.3; 114/44, 50, 51; 414/625

[56] References Cited

U.S. PATENT DOCUMENTS

| | | | |
|---|---|---|---|
| 3,853,082 | 12/1974 | Rosenberg et al. | 294/66.1 |
| 4,227,733 | 10/1980 | Haglund | 294/82.1 |
| 4,573,726 | 3/1986 | Blum | 294/82.11 |

*Primary Examiner*—Dean Kramer

*Attorney, Agent, or Firm*—Menotti J. Lombardi

[57] ABSTRACT

A length of non-corroding, filamentary material penetrates a lifting bail of the submersible equipment, and one end of the material is coupled to a hook, while the opposite end is pulled to cause the hook to snare the bail. The hook is held in suspension, but moved into proximity to the bail to enable the material to be drawn through the bail, and to cause the hook to engage the bail for sub sequent lifting of the equipment.

11 Claims, 4 Drawing Sheets

MEANS FOR, AND A METHOD OF, HANDLING A SUBMERSIBLE EQUIPMENT WHICH HAS A LIFTING BAIL

This invention pertains to means for handling submersible equipment, which has a lifting bail, from a remote location, and to a method for doing the same.

BACKGROUND OF THE INVENTION

When handling equipment which is submersed in liquid, for instance a submersible pump, it is a normal practice to have a chain attached to the equipment. An end of the chain is held above the liquid level, and when the equipment has to be lifted (and subsequently lowered), a lifting hoist is attached to the out-of-liquid end of the chain. This procedure requires a somewhat laborious engagement of a hoist hook with a shackle, and the latter with a lifting bail, or handle, on the equipment. As this operation is troublesome and time consuming, another procedure has become common. In this, a hoisting hook has its safety lock disabled, and the hook is angled to find and engage the equipment, by snaring the lifting bail thereof for instance. This introduces a considerable safety risk to the personnel as, clearly, the equipment load may loosen from the un-safetied hook, especially with any oscillation or swinging of the hook suspended load.

Another problem, which is especially important in sewage pump stations, is that the original lifting chain of the pump unit corrodes at the liquid level and, therefore, must be replaced at recurring intervals.

One way to overcome these difficulties is to arrange a guide unit from above, i.e., from ground level, down to the submersed load, and permanently attached to the submersed load. A lifting device, then, is guided along the guide unit, and down to the submersed equipment, when the equipment must be raised to ground level. The guide unit, then, must be made of a material that does not corrode, e.g., nylon for instance, and be so thin or filamentary, that it would not be mistaken for a load-lifting agent.

An example of a lifting device which operates according to the aforesaid is shown in the Swedish Patent No. 810 2854-0. In this, a lifting eye is lowered down to a submersible pump along a guide cord, and is hooked to a short chain attached to the pump. This device has good functioning for moderate weight loads, but does not meet the requirements for heavy loads where the connection between the lifting device and the pump must be more solid.

In light of the foregoing, it is an object of this invention to set forth a means for, and a method of, handling a submersible equipment, comprising a lifting device of the type that is described in the Swedish Patent No. 900 1774-0. This lifting device includes a shackle which can be turned relative to the body of the lifting device. Too, the body is provided with a lock, acted upon by the shackle, which prevents a turning of the lifting hook during lifting and/or loading, and is so designed that an unloaded lifting hook takes an evacuating, open position.

SUMMARY OF THE INVENTION

It is an object of this invention, then, to set forth means for handling a submersible equipment which has a lifting bail, comprising a length of non-corroding, filamentary material; a hook; and means supporting said hook in suspension; wherein said filamentary material is in penetration of said lifting bail of said equipment; a first end of said filamentary material is coupled to said hook; said supporting means comprises means operative for moving said hook into proximity with said bail; and means for pulling a second end of said filamentary material, for (a) drawing said filamentary material through said bail, and (b) causing said hook to snare said bail.

It is also an object of this invention to disclose a method of handling a, submersible equipment which has a lifting bail, comprising the steps of penetrating the lifting bail of the equipment with a length of non-corroding, filamentary material; suspending a lifting hook; coupling one end of said filamentary material to the hook; moving the hook into proximity with the bail; and pulling a second end of the filamentary material to cause the hook to snare the bail.

Further objects of this invention, as well as the novel features thereof, will become apparent by reference to the following description, taken in conjunction with the accompanying figures.

DETAILED DESCRIPTION OF THE PREFERRED EMBODIMENT

Figure 1:
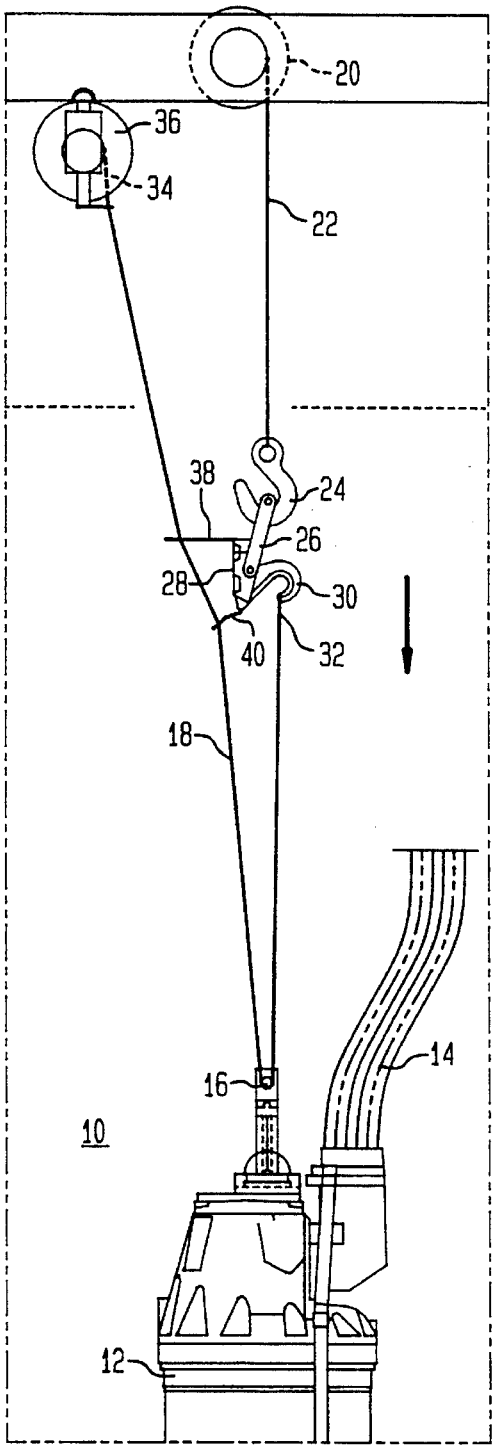
FIG. 1 is a vertical illustration of a submersible equipment, i.e., a pump, and the inventive handling means, according to an embodiment thereof, operatively engaged with the pump.

In FIG. 1, a pumping station 10 has a submersible pump 12 therein, the pump 12 has electrical cabling 14 connected thereto and a lifting bail 16 at the top thereof. A non-corroding, filamentary material 18 is in penetration of the bail 16. A hoist 20 has a chain 22 depending therefrom, the hoist 20 being set above ground level. The chain 22 is coupled to a first hook 24 which has a shackle 26 engaged therewith. A lower, depending end of the shackle 26 is pivotably coupled to a lifting hook body 28. A lifting hook 30 is also pivotably coupled to the body 28. A first end 32 of the length of filamentary material 18 is removably coupled to the tip of the hook 30. The opposite end 34 of the material 18 is connected to a take-up winch 36. A pair of limbs 38 and 40 are fixed to the body 28, and extend therefrom in a generally common direction. The limbs 38 and 40 have loops at the outermost ends thereof through which the material 18 is threaded. Consequently, the limbs 38 and 40 guide the winch-directed portion of the filamentary material 18 away from the lifting hook-directed portion thereof, so that the two portions will not become entangled inadvertently.

The aforementioned Swedish Patent No. 900 1774-0 is incorporated herein by reference, as it fully discloses the nature and structure of the body 28, the shackle 26, and the spring-biasing of the lifting hook 30. It can be seen that the lifting hook 30, in FIG. 1, is so oriented that it will snare nothing; it will engage and lift nothing in its open attitude. Spring means (not shown) disclosed in the latter Swedish patent, interposed between the body 28 and the hook 30, holds the hook in the FIG. 1 attitude thereof.

Figure 2:
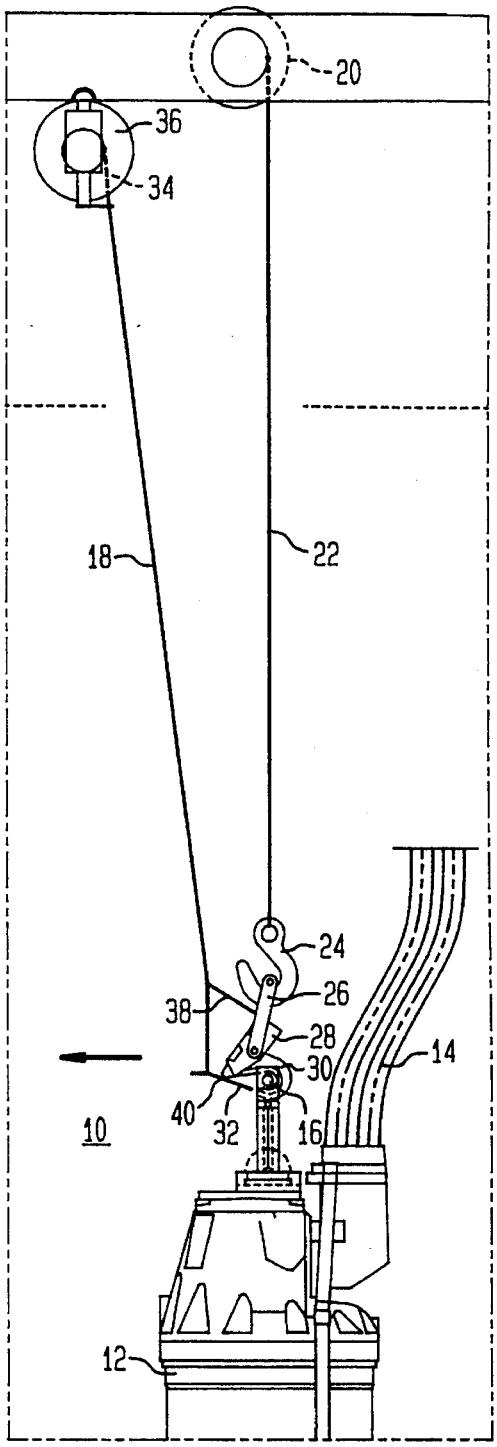
FIG. 2 is an illustration like that of FIG. 1 in which, however, the lifting hook has been lowered to, and has snared, the pump lifting bail.

The hoist 20 and the winch 36 are operated to lower the lifting hook 30 into proximity to the bail 16. This is shown in FIG. 2. The winch-connected portion of the material 18 is tensioned, by means of the winch 36, and this overcomes the bias of the aforecited spring means. Consequently, the lifting hook 30 rotates relative to the body 28, and enters and snares the bail 16. Resultantly, lifting can commence by means of the hoist 20. At this time, the body 28 is turned clockwise, relative to the shackle 26, causing a locking function, described in Swedish patent No. 900 1774-0, to be effected. In this locking function, the lifting hook 30 takes a non-turnable, fixed position relative to the body 28. The locked disposition remains until the shackle 26 has been turned in an opposite direction relative to the body 28.

Figure 3:
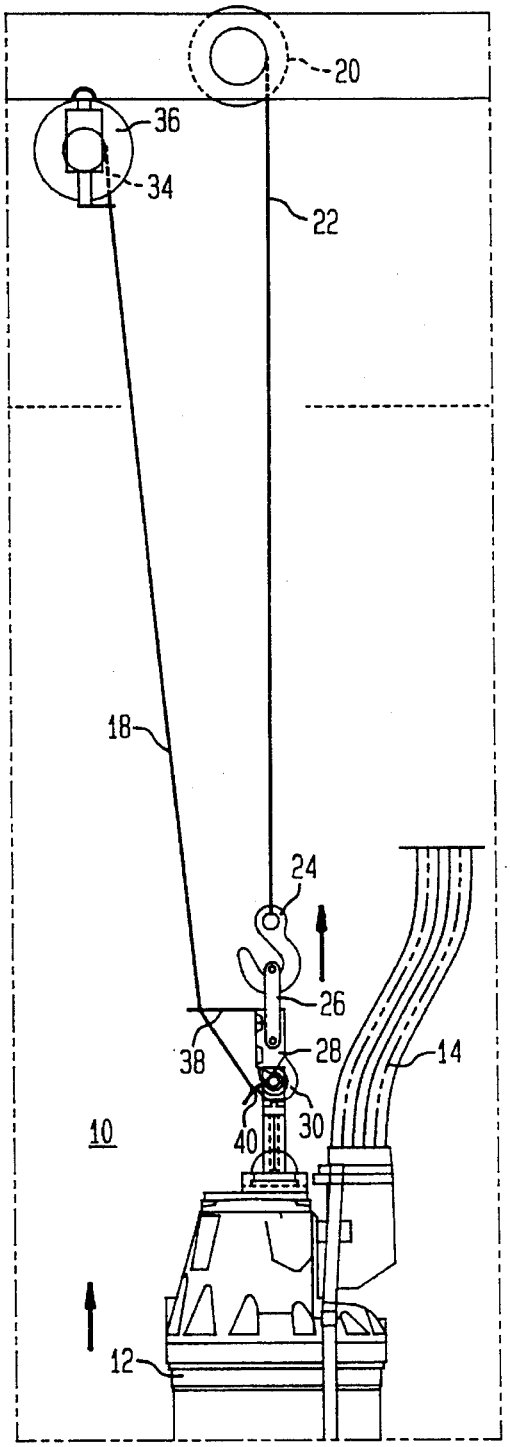
FIG. 3 is a same vertical illustration wherein, now, the novel handling means is commencing to lift the pump.

FIG. 3 shows the novel handling means during the lifting of the pump 12. The lifting hook 30 is locked in its bail-engaged disposition, defining a very secure connection to the load. The hoist 20 takes up chain 22 and the load while the winch 36 takes up material 18. Means not shown takes up the cabling 14.

When servicing of the pump 12 is completed, and the latter has to be returned to its operating disposition in the station 10, the novel handling means is employed again. During lowering of the serviced pump 12 into the station 10, the several components and parts take the dispositions shown in FIG. 3.

Figure 4:
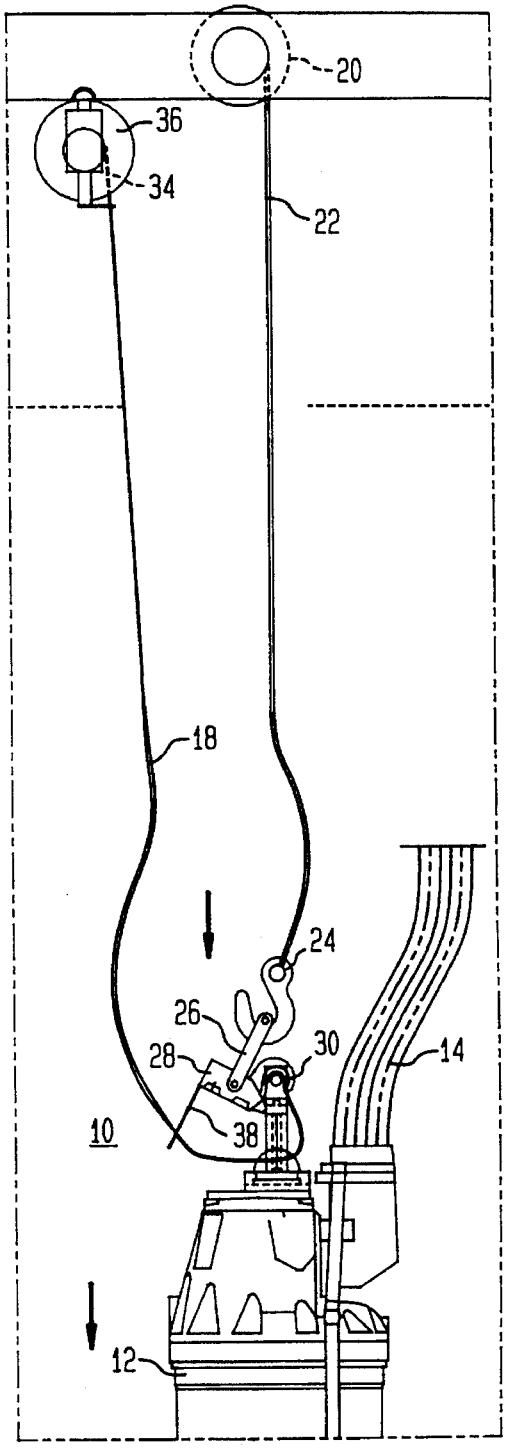
FIG. 4 depicts a same vertical illustration in which, now, the filamentary material is relaxed in order that the lifting hook can be released from the bail.

FIG. 4 represents the disengagement of the lifting hook 30 from the bail 16, upon the pump 12 having been set down in the station 10. The shackle 26 is turned by gravity clockwise relative to the body 28. This releases the aforesaid locking function so that the lifting hook 30 can be turned counter-clockwise and disengage from the bail 16. The winch 36 is operated to provide an adequate slack in the associated portion of the filamentary material 18, and the cited spring biasing, between the body 28 and the hook 30, causes the hook 30 to rotate, as noted, to its horizontal or open attitude.

Figure 5:
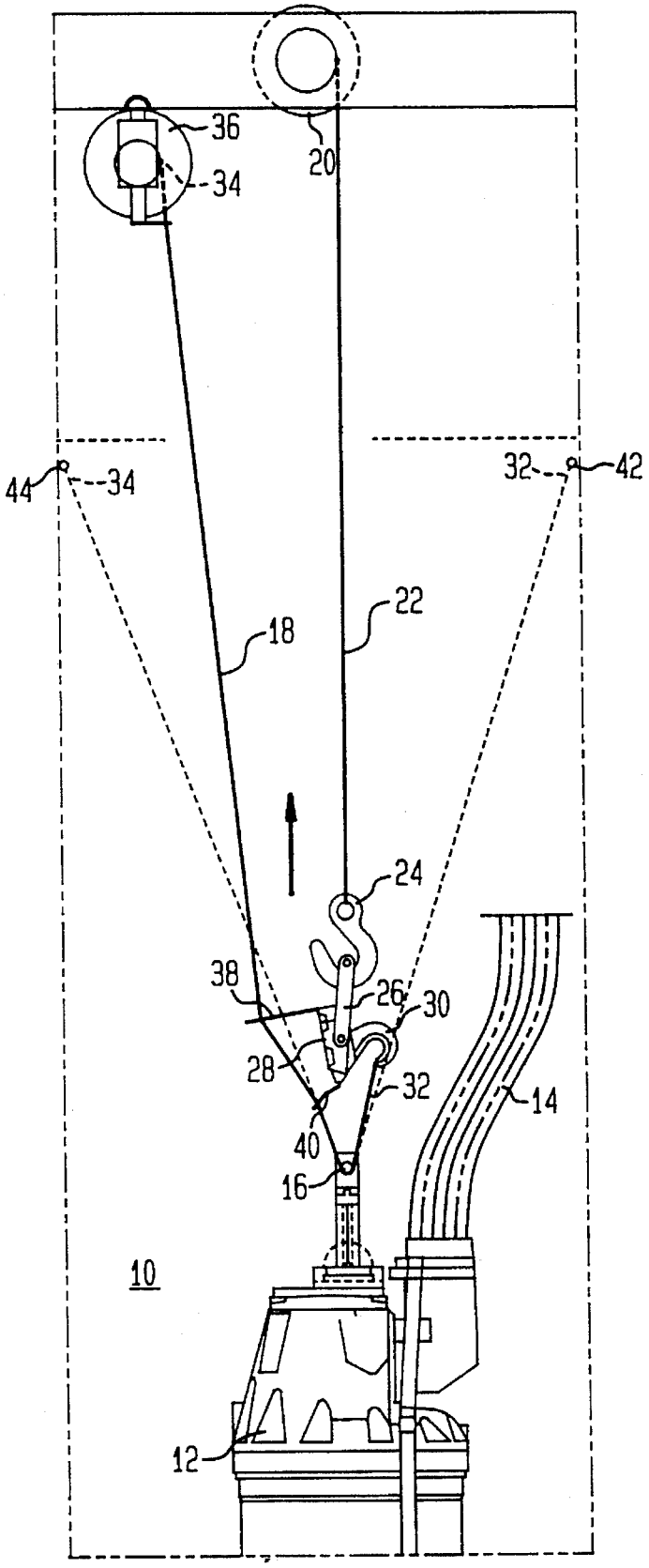
FIG. 5 shows the novel handling means being withdrawn from the pump, having served its function, and being disposed in a storage status.

Now, as shown in FIG. 5, the novel handling means can be raised again, above the pump 12, for a storage disposition until it is needed again. Upon the hoist 20 and the winch 36 raising the handling means to the top of the station 10, the end 32 of the filamentary material 18 can be disengaged from the hook 30 and set at a station mounting 42, and the end 34 can be disconnected from the winch 36 and set at a mounting 44.

Figure 6:
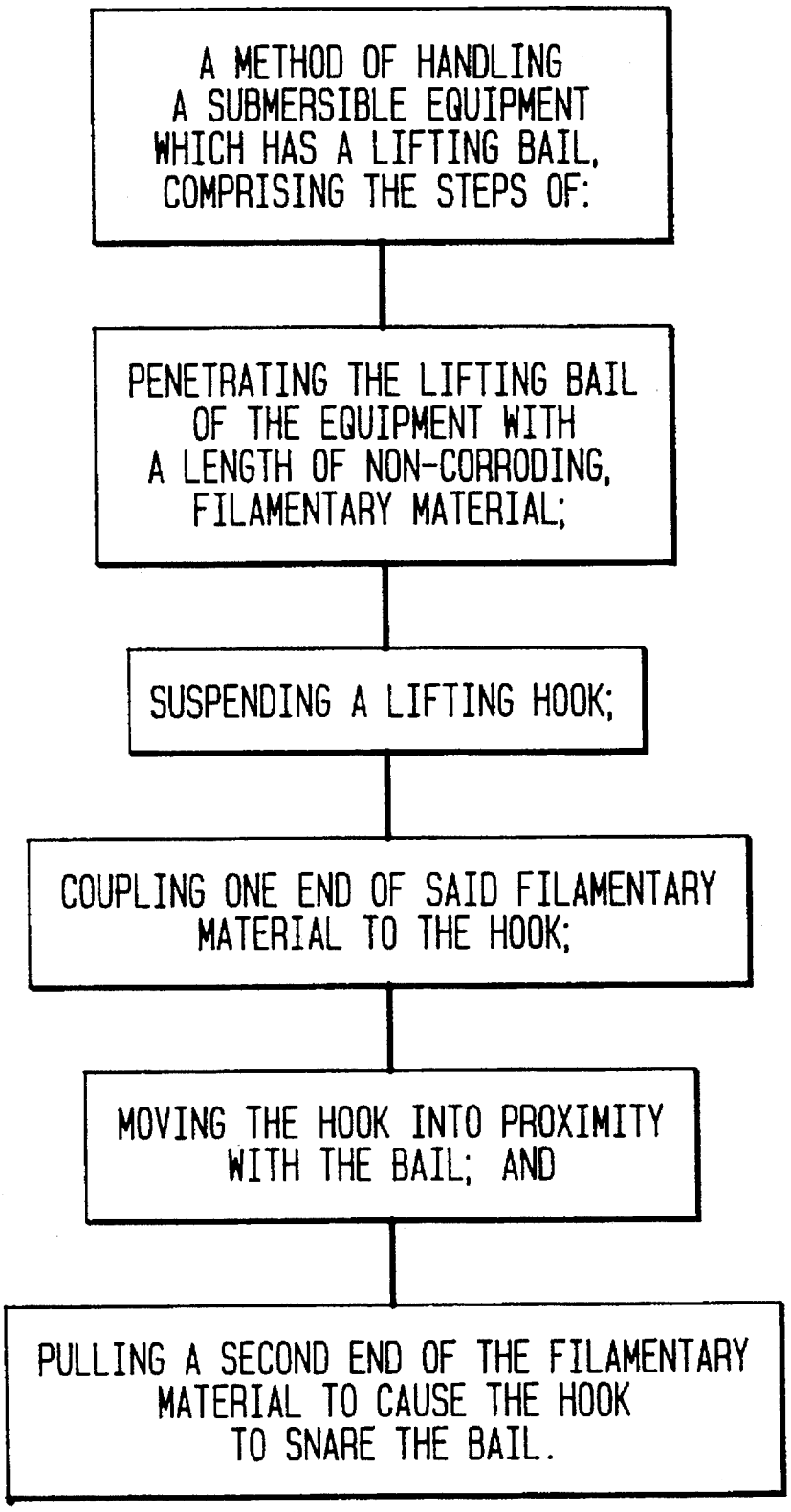
FIG. 6 is a flow diagram of the novel method as disclosed herein.

FIG. 6 outlines the steps comprised by the novel method of handling a submersible equipment, such as pump 12, namely: penetrating the lifting bail 16 of the equipment with a length of non-corroding, filamentary material 18; suspending a lifting hook 30; coupling one end 32 of the filamentary material to the hook 30; moving the hook into proximity with the bail 16; and pulling a second end 34 of the filamentary material to cause the hook 30 to snare the bail 16.

While I have described my invention in connection with a specific embodiment thereof, and particular steps of procedure, it is to be clearly understood that this is done only by way of example, and not as a limitation to the scope of the invention as set forth in the objects thereof and in the appended claims.

I claim:

1. Means for handling a submersible equipment which has a lifting bail, comprising:

a length of non-corroding, filamentary material;

a hook; and means supporting said hook in suspension; wherein said filamentary material is in penetration of said lifting bail of said equipment;

a first end of said filamentary material is coupled to said hook;

said supporting means comprises means operative for moving said hook into proximity with said bail; and means for pulling a second end of said filamentary material, for (a) drawing said filamentary material through said bail, and (b) causing said hook to snare said bail.

2. Means for handling a submersible equipment, according to claim 1, further including:

a body; and wherein said hook is pivotably coupled to said body.

3. Means for handling a submersible equipment, according to claim 2, further including:

a linkage; and wherein said linkage is pivotably coupled to said body; and said supporting means is removably coupled to said linkage.

4. Means for handling a submersible equipment, according to claim 3, wherein:

said linkage comprises a shackle; and said supporting means comprises a hoisting assembly.

5. Means for handling a submersible equipment, according to claim 2, wherein:

said body has means for guiding said filamentary material upon said filamentary material moving relative to said body.

6. Means for handling a submersible equipment, according to claim 5, wherein:

said guiding moans comprises a limb coupled to said body and projecting outwardly from said body.

7. Means for handling a submersible equipment, according to claim 5, wherein:

said guiding moans comprises a pair of limbs coupled to said body, at opposite ends thereof, and projecting outwardly, in a generally common direction, from said body.

8. Means for handling a submersible equipment, according to claim 1, wherein:

said pulling moans comprises a take-up device.

9. Means for handling a submersible equipment, according to claim 8, wherein:

said device comprises a winch.

10. A method of handling a submersible equipment which has a lifting bail, comprising the steps of:

penetrating the lifting bail of the equipment with a length of non-corroding, filamentary material;

suspending a lifting hook;

coupling one end of said filamentary material to the hook;

moving the hook into proximity with the bail; and pulling a second end of the filamentary material to cause the hook to snare the bail.

11. A method of handling a submersible equipment, according to claim 10, wherein:

said hook suspending step comprises suspending the hook from a hoisting assembly.

* * * * *